US008866395B2

(12) United States Patent
Yamamura et al.

(10) Patent No.: US 8,866,395 B2
(45) Date of Patent: Oct. 21, 2014

(54) DISPLAY APPARATUS USING A BACKLIGHT

(75) Inventors: Akihiro Yamamura, Osaka (JP); Isao Matsuda, Hyogo (JP); Yoshio Umeda, Hyogo (JP)

(73) Assignee: Panasonic Liquid Crystal Display Co., Ltd., Hyogo (JP)

( * ) Notice: Subject to any disclaimer, the term of this patent is extended or adjusted under 35 U.S.C. 154(b) by 137 days.

(21) Appl. No.: 13/596,956

(22) Filed: Aug. 28, 2012

(65) Prior Publication Data

US 2013/0049616 A1 Feb. 28, 2013

(30) Foreign Application Priority Data

Aug. 29, 2011 (JP) ..... 2011-186048

(51) Int. Cl.
*H05B 37/02* (2006.01)
*H05B 33/08* (2006.01)

(52) U.S. Cl.
CPC ..... *H05B 33/0827* (2013.01)
USPC ..... 315/192; 315/294

(58) Field of Classification Search
USPC ..... 315/192, 294, 297, 323, 299, 307
See application file for complete search history.

(56) References Cited

U.S. PATENT DOCUMENTS

| | | | | |
|---|---|---|---|---|
| 8,330,393 | B2 * | 12/2012 | Thomson et al. | 315/308 |
| 2009/0302776 | A1 * | 12/2009 | Szczeszynski | 315/246 |
| 2010/0134040 | A1 * | 6/2010 | Elder | 315/294 |
| 2011/0062872 | A1 * | 3/2011 | Jin et al. | 315/122 |
| 2012/0181939 | A1 * | 7/2012 | Szczeszynski et al. | 315/186 |

FOREIGN PATENT DOCUMENTS

JP 2007-273204 A 10/2007

* cited by examiner

*Primary Examiner* — Daniel D Chang
(74) *Attorney, Agent, or Firm* — McDermott Will & Emery LLP

(57) ABSTRACT

The instant application describes a display apparatus that includes a display panel configured to display an image; and a backlight unit configured to illuminate the display panel from a back of the display panel. The backlight unit includes: N light-emitting diode strings connected in parallel with each other, each of the N light-emitting diode strings includes M light-emitting diodes connected in series, N being an integer of 2 or more and M being an integer of 1 or more; a power source unit connected in series with the N light-emitting diode strings and configured to generate a voltage; a drive unit connected in series with the N light-emitting diode strings and the power source unit and configured to supply currents to the N light-emitting diode strings; and a current regulator configured to regulate current flowing in each of the N light-emitting diode strings.

9 Claims, 16 Drawing Sheets

DISPLAY APPARATUS USING A BACKLIGHT

CROSS-REFERENCE TO RELATED APPLICATIONS

This application claims the benefit of priority to Japanese Patent application No. 2011-186048 filed on Aug. 29, 2011, the entire content of which is hereby incorporated herein by reference.

TECHNICAL FIELD

The present application relates to a display apparatus using a backlight.

BACKGROUND

A display apparatus that has a display panel using a non-self-emission type liquid crystal as a light modulation element has a backlight unit for illuminating the display panel from the back and displays an image by controlling the transmittance of the light emitted from the backlight unit using the liquid crystal. Light-emitting diodes and the like are used as light sources of the backlight unit (see Japanese Patent Application Publication No. 2007-273204, for example).

However, the technology described in Japanese Patent Application Publication No. 2007-273204 needs to measure the resistance values of the light-emitting diodes and calculates the average and standard deviation of the measured resistance values to select the light-emitting diode having a desired resistance value. This results in an increase in labor and costs for measuring a resistance value, calculating the average and standard deviation, selecting the light-emitting diode and the like.

To this end, there is a need for a display apparatus that is capable of preventing or reducing variation in the light quantity of light-emitting diodes, which is caused by fluctuations in forward voltages of the light-emitting diodes, without increasing labor and costs.

SUMMARY

In one general aspect, the instant application describes a display apparatus that includes a display panel configured to display an image; and a backlight unit configured to illuminate the display panel from a back of the display panel. The backlight unit includes: N light-emitting diode strings connected in parallel with each other, each of the N light-emitting diode strings includes M light-emitting diodes connected in series, N being an integer of 2 or more and M being an integer of 1 or more; a power source unit connected in series with the N light-emitting diode strings and configured to generate a voltage; a drive unit connected in series with the N light-emitting diode strings and the power source unit and configured to supply currents to the N light-emitting diode strings; and a current regulator configured to regulate current flowing in each of the N light-emitting diode strings.

The above general aspect may include one or more of the following features. The current regulator may include a reference voltage generating circuit configured to generate a reference voltage; a resistor element and a current regulating element connected in series with each of the N light-emitting diode string; and a control circuit configured to control the current regulating element based on the reference voltage generated by the reference voltage generating circuit and a detection voltage detected by the resistor element.

The current regulating element may include a transistor connected in series with each of the N light-emitting diode strings. The control circuit may include an amplifier circuit configured to generate a voltage, which controls the transistor, based on the reference voltage and the detection voltage. The amplifier circuit may include a differential amplifier circuit.

The current regulating element may include a transistor connected in series with each of the N light-emitting diode strings. The control circuit may include a Pulse Width Modulation (PWM) circuit configured to output a PWM signal, which controls the transistor based on the reference voltage and the detection voltage. The transistor may include a field-effect transistor.

The apparatus may further include a light emission controller configured to control, out of the N light-emitting diode strings, K light-emitting diode strings to which the currents are supplied simultaneously from the drive unit. K may be an integer of 2 or more but less than N. The current regulator may be configured to regulate each current flowing in each of the K light-emitting diode strings.

The apparatus may further include a light emission controller configured to perform a control so that the current is supplied from the drive unit to each of the N light-emitting diode strings sequentially and one by one. The current regulator may be configured to regulate each current that is supplied to each of the N light-emitting diode strings sequentially and one by one by the light emission controller.

The light emission controller may be configured to perform a control so that the current is supplied from the drive unit to the one or each of the K light-emitting diode strings at a predetermined period. The current regulator may be configured to regulate each current supplied to the one or each of the K light-emitting diode strings at the predetermined period by the light emission controller.

Each of the N light-emitting diode strings may illuminate different regions of the display panel. The N light-emitting diode strings may include a first light-emitting diode string and a second light-emitting diode string, illuminating the regions adjacent to each other. The light emission controller may be configured to perform a control so that current is supplied from the drive unit to only the first light-emitting diode string during a first period, that current is supplied from the drive unit to each of the first and second light-emitting diode strings during a second period subsequent to the first period, and that current is supplied from the drive unit to only the second light-emitting diode string during a third period subsequent to the second period.

BRIEF DESCRIPTION OF THE DRAWINGS

The figures depict one or more implementations in accordance with the present teachings, by way of example only, not by way of limitations. In the figures, like reference numerals refer to the same or similar elements

DETAILED DESCRIPTION

In the following detailed description, numerous specific details are set forth by way of examples in order to provide a thorough understanding of the relevant teachings. However, it should be apparent to those skilled in the art that the present teachings may be practiced without exemplary details. In other instances, well known methods, procedures, components, and/or circuitry have been described at a relatively high-level, without detail, in order to avoid unnecessarily obscuring aspects of the present concepts.

Figure 1:
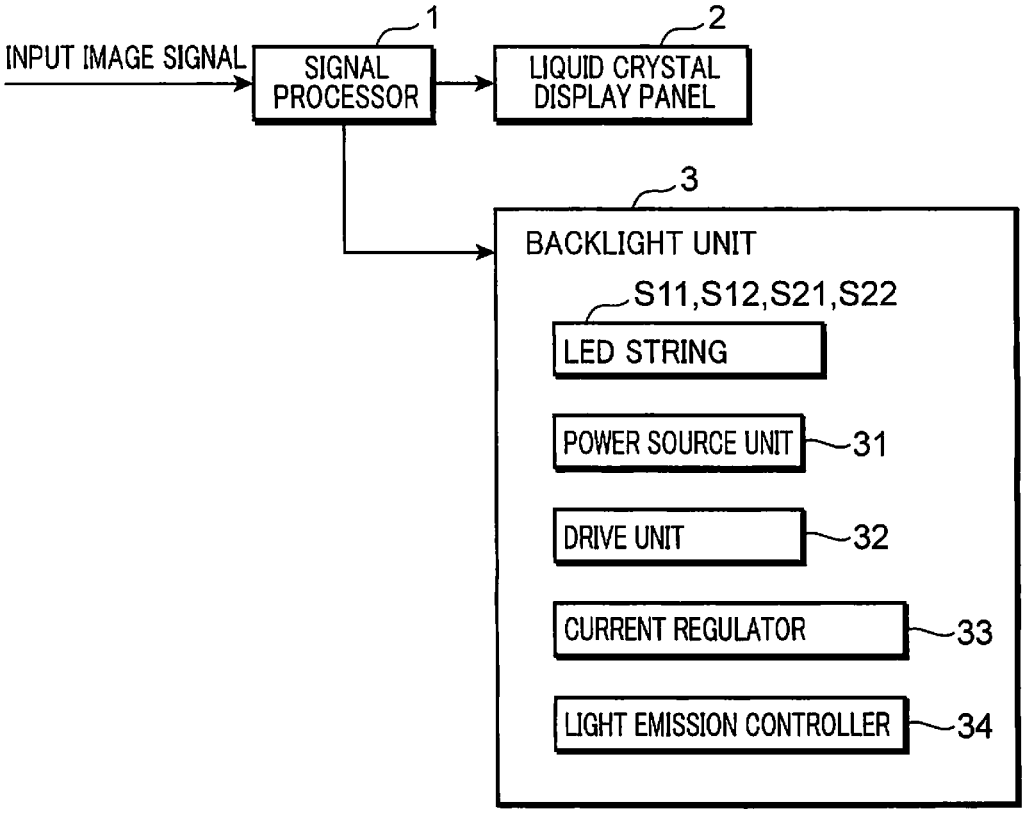
FIG. 1 is a block diagram showing a configuration of an exemplary liquid crystal display apparatus of the instant application.
Figure 2:
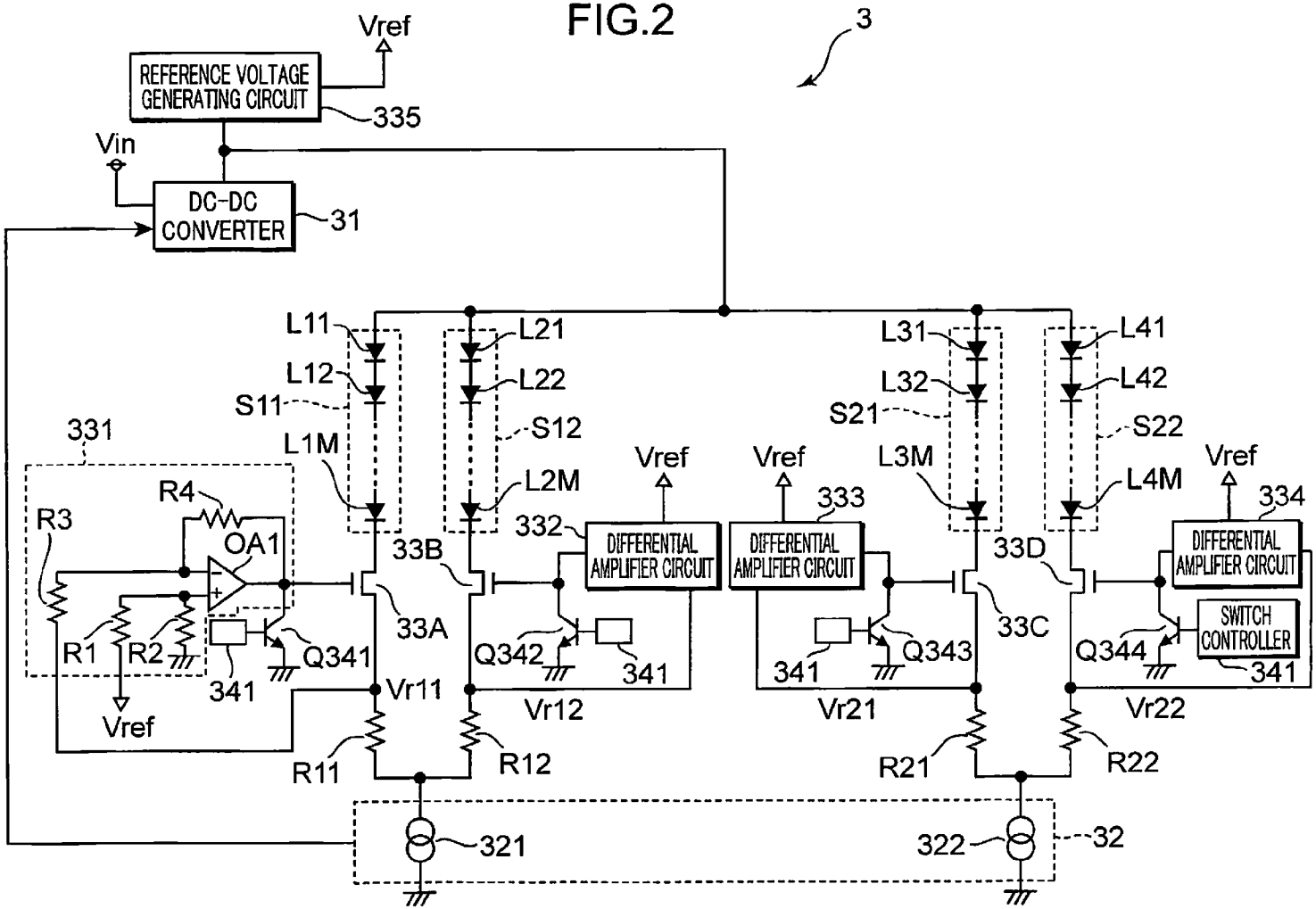
FIG. 2 is a circuit block diagram showing an example of a circuit configuration of a backlight unit of the display apparatus shown in FIG. 1.

FIG. 1 is a block diagram showing a configuration of an exemplary liquid crystal display apparatus of the instant application. FIG. 2 is a circuit block diagram showing an example of a circuit configuration of a backlight unit of the liquid crystal display apparatus shown in FIG. 1.

The liquid crystal display apparatus shown in FIG. 1 has a signal processor 1, a liquid crystal display panel 2, and a backlight unit 3. The signal processor 1 generates a control signal for controlling the liquid crystal display panel 2 and a control signal for controlling the backlight unit 3 on the basis of an input image signal from outside, and outputs the control signals for controlling the liquid crystal display panel 2 to and the control signal for controlling the backlight unit 3 to the backlight unit 3. Although not shown, the liquid crystal display panel 2 has a plurality of gate lines extending in a horizontal direction, a plurality of source lines extending in a vertical direction, a switching element, and a plurality of pixels, wherein the plurality of pixels are disposed in the form of a matrix at the intersections of the plurality of source lines with the plurality of gate lines. An IPS (In Plane Switching) system, VA (Vertical Alignment) system, or other drive systems may be employed as the liquid crystal display panel 2. The IPS system, for example, is employed in present implementation.

The backlight unit 3 illuminates the liquid crystal display panel 2 from the back of the liquid crystal display panel 2. An edge-type backlight system or direct-type backlight system may be employed as an illumination system of the backlight unit 3. The edge-type backlight system, for example, is employed in the present implementation. The backlight unit 3 has light-emitting diode strings (referred to as "LED strings" hereinafter) S11, S12, S21, and S22, a power source unit 31, a drive unit 32, a current regulator 33, and a light emission controller 34.

As shown in FIG. 2, the LED string S11 includes M white light-emitting diodes L11, L12, . . . , L1M (e.g., M=10) connected in series. Similarly, the LED string S12 includes M white light-emitting diodes L21, L22, . . . L2M connected in series. The LED string S21 includes M white light-emitting diodes L31, L32, . . . L3M connected in series. The LED string S22 includes M white light-emitting diodes L41, L42, . . . L4M connected in series. The LED strings S11 and S12 constitute one group of light-emitting diode strings. The LED strings S21 and S22 constitute another group of light-emitting diode strings.

The power source unit (DC-DC converter) 31 generates a DC voltage from an input voltage Vin to supply power to the LED strings S11, S12, S21, and S22. The drive unit 32 supplies current to the LED strings S11, S12, S21, and S22. The current regulator 33 regulates the current flowing in the LED strings S11, S12, S21, and S22. The light emission controller 34 controls turning-on and turning-off of the LED strings S11, S12, S21, and S22.

In the example of the circuit configuration shown in FIG. 2, the drive unit 32 includes constant current sources 321 and 322. The current regulator 33 includes differential amplifier circuits 331 to 334, a reference voltage generating circuit 335, field-effect transistors 33A to 33D, and current sensing resistors R11 to R14. The light emission controller 34 includes switch controller 341 and transistors Q341 to Q344.

The DC-DC converter 31 is connected in series with the LED strings S11, S12, S21, and S22. The reference voltage generating circuit 335 generates a reference voltage Vref using the voltage generated by the DC-DC converter 31. A drain and a source of the field-effect transistor 33A and the current sensing resistor R11 are connected in series with the LED string S11. Similarly, a drain and a source of the field-effect transistor 33B and the current sensing resistor R12 are connected in series with the LED string S12. The series circuit including the LED string S11, the field-effect transistor 33A and the current sensing resistor R11, and the series circuit including the LED string S12, the field-effect transistor 33B and the current sensing resistor R12 are connected in parallel with each other. This parallel circuit is connected in series between the DC-DC converter 31 and the constant current source 321.

The differential amplifier circuits 331 and 332 are connected to gates of the field-effect transistors 33A and 33B, respectively. The collectors of the transistors Q341 and Q342 are connected to the gates of the field-effect transistors 33A and 33B, respectively. A switch controller 341 is connected to the base of the transistor Q341. A switch controller 341 is connected to the base of the transistor Q342. The emitters of the transistors Q341 and Q342 are grounded. For convenience of illustration, the switch controller 341 is shown at four places in FIG. 2.

The differential amplifier circuit 331 has a two-input one-output operational amplifier OA1 and resistors R1 to R4. A non-inverting input terminal of the operational amplifier OA1 is connected to a reference voltage output terminal of the reference voltage generating circuit 335 via the resistor R1, and is grounded via the resistor R2. An inverting input terminal of the operational amplifier OA1 is connected to an end part of the current sensing resistor R11 on the field-effect transistor 33A side via the resistor R3, and is connected to an output terminal of the operational amplifier OA1 via the resistor R4. The output terminal of the operational amplifier OA1 is further connected to the gate of the field-effect transistor 33A. Note that the differential amplifier circuit 332 has the same configuration as the differential amplifier circuit 331.

Peripheral circuits around the LED strings S21 and S22 are also configured in the same manner as those around the LED strings S11 and S12. In other words, the series circuit including the LED string S21, the field-effect transistor 33C, and the current sensing resistor R21, and the series circuit including the LED string S22, the field-effect transistor 33D, and the current sensing resistor R22 are connected in parallel with each other. This parallel circuit is connected in series between the DC-DC converter 31 and the constant current source 322. The other circuit configurations are the same as those of the LED strings S11 and S12 described above. In the circuit configuration shown in FIG. 2, two LED strings are connected in parallel with one constant current source. However, the number of LED strings to be connected in parallel is not necessarily limited to two and can be three or more. Furthermore, the circuit configuration shown in FIG. 2 has two constant current sources 321 and 322. However, the number of constant current sources is not necessarily limited to two and can be three or more.

Operations of the backlight unit 3 configured as described above are now described. The LED strings S11 and S12 are connected in parallel with the constant current source 321. In the circuit configuration in which the parallel circuit of the LED strings S11 and S12 is simply connected to the constant current source 321, when there are fluctuations in forward voltages Vf of the light-emitting diodes L11 and L12 and the like configuring the LED strings S11 and S12, respectively, the currents supplied by the constant current source 321 do not flow evenly to the LED strings S11 and S12, causing variations in the light quantity of the LED strings S11 and S12.

In the configuration shown in FIG. 2, on the other hand, the differential amplifier circuit 331 regulates a gate voltage of the field-effect transistor 33A in accordance with a detection voltage Vr11 of the current sensing resistor R11 and the reference voltage Vref. In other words, when the Vr11 is greater than the Vref, the differential amplifier circuit 331 reduces the gate voltage of the field-effect transistor 33A. When the Vr11 is lower than the Vref, on the other hand, the differential amplifier circuit 331 increases the gate voltage of the field-effect transistor 33A. The differential amplifier circuits 332, 333, and 334 are operated in the same manner as the differential amplifier circuit 331. Therefore, the differential amplifier circuits 331 to 334 regulate the gate voltages of the field-effect transistors 33A to 33D respectively, so that the detection voltages Vr11, Vr12, Vr21, and Vr22 of the current sensing resistors R11, R12, R21, and R22 become equal to one another as follows: Vr11=Vr12=Vr21=Vr22. As a result, the currents flow evenly to the LED strings S11, S12, S21, and S22, preventing or reducing the variations in the light quantity of the light-emitting diodes L11 and the like.

According to the above-described implementation, the current sensing resistor R11 and the field-effect transistor 33A are connected in series with the LED string S11. The current sensing resistor R12 and the field-effect transistor 33B are connected in series with the LED string S12. The current sensing resistor R21 and the field-effect transistor 33C are connected in series with the LED string S21. The current sensing resistor R22 and the field-effect transistor 33D are connected in series with the LED string S22. The differential amplifier circuits 331-334 regulate the gate voltages of the field-effect transistors 33A-33D respectively in accordance with the detection voltages of the current sensing resistors and the reference voltage Vref. As a result, the currents flow evenly to the LED strings S11, S12, S21, and S22. Therefore, even when there are fluctuations in the forward voltages of the light-emitting diodes L11 and the like, preventing or reducing the variation in the light quantity of the light-emitting diodes L11 and the like without increasing the labor and costs.

The field-effect transistors 33A and 33B are connected in series with the constant current source 321, and the field-effect transistors 33C and 33D are connected in series with the constant current source 322. Hence, withstand voltages of the constant current sources 321 and 322 can be increased by the level of withstand voltages of the field-effect transistors.

As described with reference to FIG. 2, in the present implementation, the LED strings S11 and S12 are connected in parallel with each other with respect to the constant current source 321, and the LED strings S21 and S22 are connected in parallel with each other with respect to the constant current source 322. Next are described examples of specific operations that are performed in such a configuration where the LED strings are connected in parallel with each other with respect to the constant current sources.

Figure 3:
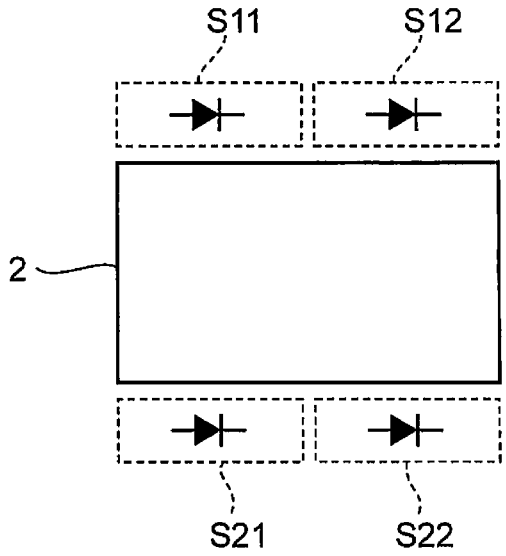
FIG. 3 is a diagram schematically showing an example of an arrangement of LED strings.
Figure 4:
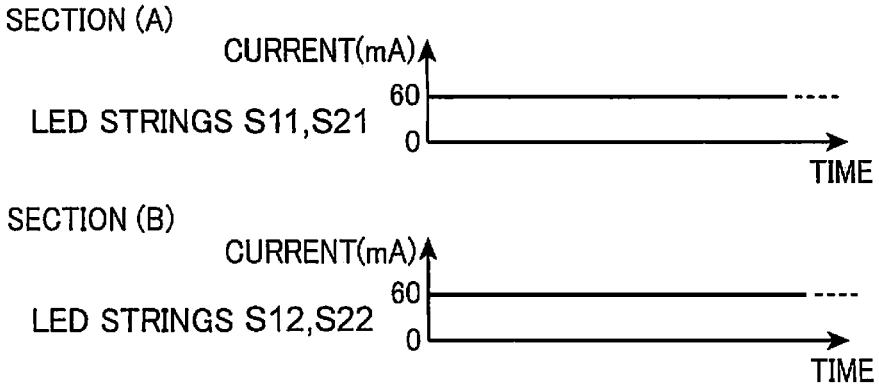
FIG. 4 is a timing chart showing an example of operations by the LED strings in the configuration shown in FIG. 2.

FIG. 3 is a diagram schematically showing an example of an arrangement of the LED strings. FIG. 4 is a timing chart showing an example of operations by the LED strings in the configuration shown in FIG. 2. Section (A) of FIG. 4 shows current flowing in the LED strings S11 and S21. Section (B) of FIG. 4 shows current flowing in the LED strings S12 and S22.

As shown in FIG. 3, the LED string S11 is disposed in a left half part of an upper end of the liquid crystal display panel 2. The LED string S12 is disposed in a right half part of the upper end of the liquid crystal display panel 2. The LED string S21 is disposed in a left half part of a lower end of the liquid crystal display panel 2. The LED string S22 is disposed in a right half part of the lower end of the liquid crystal display panel 2.

In the present implementation, suppose that the constant current sources 321 and 322 have a rated current of 120 mA. As shown in FIG. 4, when steadily supplying current to each of the LED strings, the constant current source 321 can supply current of 60 mA to the LED strings S11 and S12 because the LED strings S11 and S12 are connected in parallel with each other with respect to the constant current source 321. Similarly, the constant current source 322 can supply current of 60 mA to the LED strings S21 and S22 because the LED strings S21 and S22 are connected in parallel with each other with respect to the constant current source 322. This supply of current can illuminate the liquid crystal display panel 2 by means of the LED strings S11, S12, S21, and S22.

Figure 5:
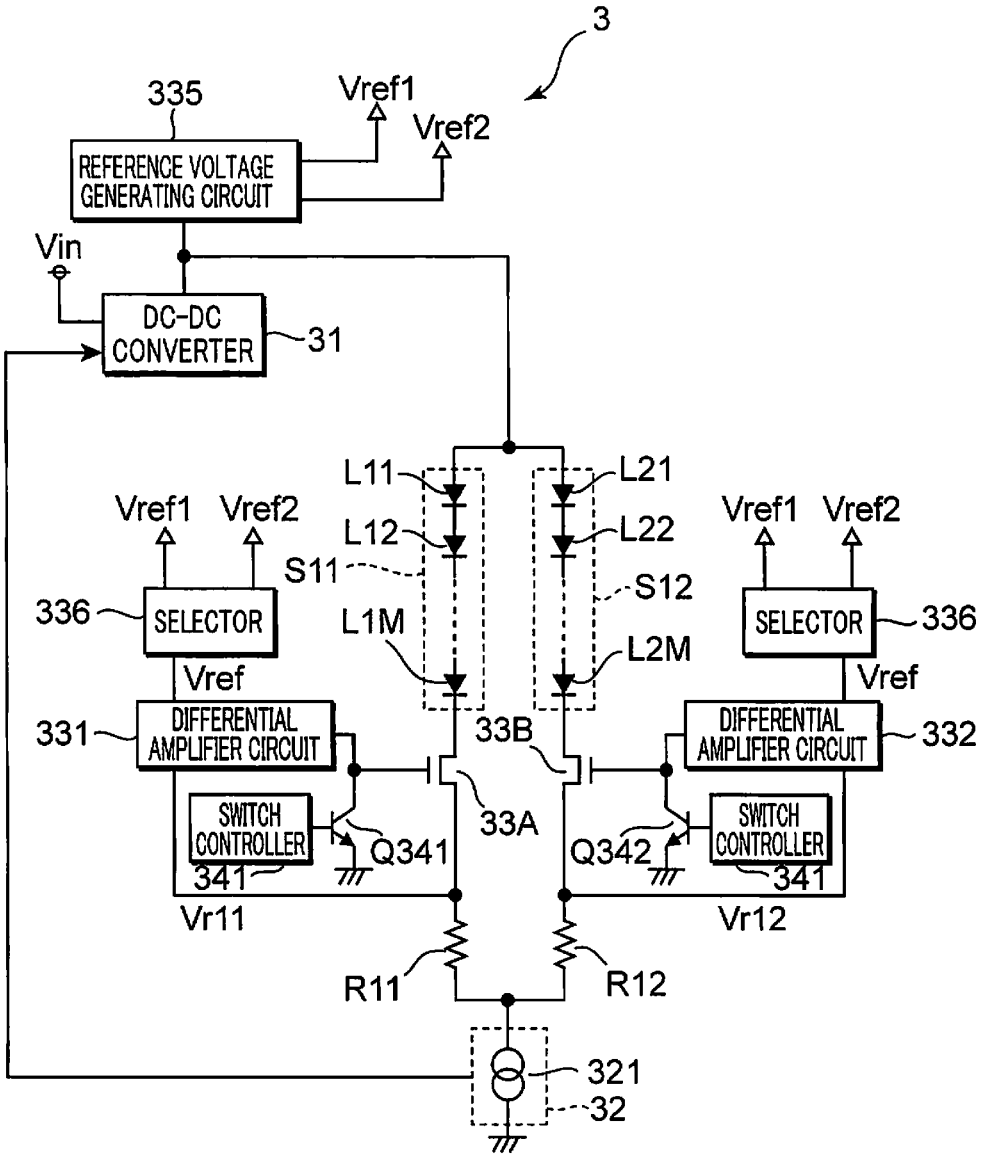
FIG. 5 is a circuit block diagram showing another example of the circuit configuration of the backlight unit.
Figure 6:
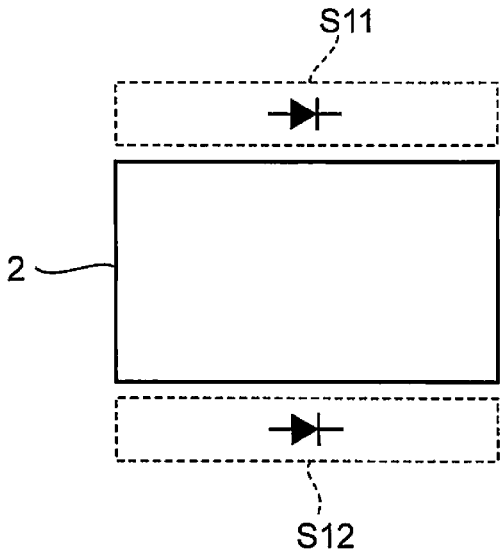
FIG. 6 is a diagram schematically showing an example of an arrangement of the LED strings in the circuit configuration shown in FIG. 5.

FIG. 5 is a circuit block diagram showing another example of the circuit configuration of the backlight unit 3. FIG. 6 is a diagram schematically showing an example of an arrangement of the LED strings in the circuit configuration shown in FIG. 5. The backlight unit 3 shown in FIG. 5 has one constant current source 321 and two LED strings S11 and S12. In the circuit configuration shown in FIG. 5, the two LED strings S11 and S12 are connected in parallel with the one constant current source 321. However, the number of LED strings connected in parallel is not limited to two and can be three or more. Further, the circuit configuration shown in FIG. 5 has one constant current source 321. However, the number of constant current sources is not limited to one and can be two or more.

In the circuit configuration shown in FIG. 5, the drive unit 32 includes the constant current source 321. The current regulator 33 includes the differential amplifier circuits 331, 332, the reference voltage generating circuit 335, the field-effect transistors 33A and 33B, the current sensing resistors R11 and R12, and the selector 336. Furthermore, the light emission controller 34 includes the switch controller 341 and the transistors Q341 and Q342.

The reference voltage generating circuit 335 generates a first reference voltage Vref1 and a second reference voltage Vref2. Here, Vref1 may be greater than Vref2. The selector 336 outputs either the first reference voltage Vref1 or the second reference voltage Vref2 to the differential amplifier circuits 331 and 332 as the reference voltage Vref of the differential amplifier circuits 331 and 332. The selector 336 is configured so as to be able to output the same reference voltage or different reference voltages to the differential amplifier circuits 331 and 332. Note that, for convenience of illustration, the selector 336 is shown at two places in FIG. 5.

As shown in FIG. 6, the LED string S11 is disposed in an upper part of the liquid crystal display panel 2, and the LED string S12 is disposed in a lower part of the liquid crystal display panel 2.

Figure 7:
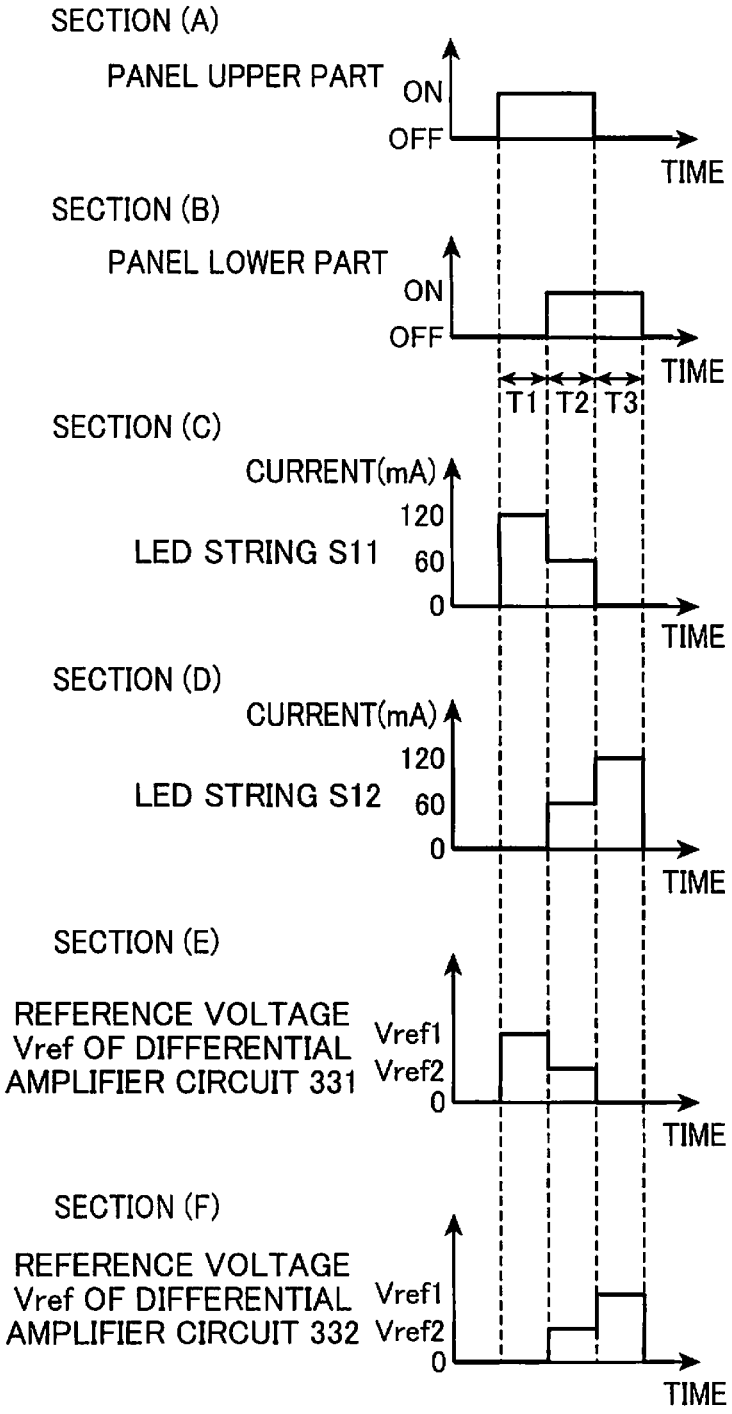
FIG. 7 is a timing chart showing an example of operations by the LED strings in the configuration shown in FIG. 5.

FIG. 7 is a timing chart showing an example of operations by the LED strings in the configuration shown in FIG. 5. Section (A) of FIG. 7 shows a turning-on timing of an upper part of the liquid crystal display panel 2. Section (B) of FIG. 7 shows a switch-on timing of a lower part of the liquid crystal display panel 2. Section (C) of FIG. 7 shows current flowing in the LED string S11. Section (D) of FIG. 7 shows current flowing in the LED string S12. Section (E) of FIG. 7 shows the reference voltage Vref of the differential amplifier circuit 331 that is output from the selector 336. Section (F) of FIG. 7 shows the reference voltage Vref of the differential amplifier circuit 332 that is output from the selector 336.

As shown in Sections (A) and (B) of FIG. 7, first, the upper part of the liquid crystal display panel 2 is turned on during a period T1. In the subsequent period T2, the lower part of the liquid crystal display panel 2 is turned on, while the upper part is kept turning on. In the subsequent period T3, the upper part of the liquid crystal display panel 2 is turned off, but the lower part remains turned on. Described next is the operations of the LED strings that are performed when the on-duties of the upper part and lower part of the liquid crystal display panel 2 overlap with each other.

In the operations shown in FIG. 7, on-off of the LED string S11 is achieved by on-off of the transistor Q341. In other words, when the switch controller 341 outputs a high-level signal to the base of the transistor Q341, the transistor Q341 is turned on. The gate voltage of the field-effect transistor 33A drops, which turns off the field-effect transistor 33A. As a result, the LED string S11 is turned off. On the other hand, when the switch controller 341 outputs a low-level signal to the base of the transistor Q341, the transistor Q341 is turned off. The gate voltage of the field-effect transistor 33A reaches the value determined by the differential amplifier circuit 331, which turns on the field-effect transistor 33A. As a result, the LED string S11 is turned on. The LED string S12 is turned on and off by the transistor Q342 in the same manner.

First, when the period T1 starts, that is, when the upper part of the liquid crystal display panel 2 is turned on, the transistor Q341 is turned off, and, as shown in Section (E), the first reference voltage Vref1 is output as the reference voltage Vref, from the selector 336 to the differential amplifier circuit 331. Therefore, the differential amplifier circuit 331 regulates the gate voltage of the field-effect transistor 33A in accordance with the detection voltage Vr11 and the first reference voltage Vref1. As a result, current of 120 mA is supplied to the LED string S11, whereby the LED string S11 is turned on, as shown in Section (C). At this moment, the transistor Q342 remains on, and no current is supplied to the LED string S12. As a result, only the upper part of the liquid crystal display panel 2 may be illuminated at relatively high intensity.

At the time the subsequent period T2 is started, that is, when the lower part of the liquid crystal display panel 2 is turned on, the transistor Q342 is turned off, and, as shown in Section (F), the second reference voltage Vref2 is output as the reference voltage Vref, from the selector 336 to the differential amplifier circuit 332. Therefore, the differential amplifier circuit 332 regulates the gate voltage of the field-effect transistor 33B in accordance with the detection voltage Vr12 and the second reference voltage Vref2. As a result, current of 60 mA is supplied to the LED string S12, whereby the LED string S12 is turned on, as shown in Section (F). At the same time, that is, when the period T2 is started, the voltage that is output as the reference voltage Vref from the selector 336 to the differential amplifier circuit 331 is changed from the first reference voltage Vref1 to the second reference voltage Vref2, while the transistor Q341 remains off, as shown in Section (E). Therefore, the differential amplifier circuit 331 regulates the gate voltage of the field-effect transistor 33A in accordance with the detection voltage Vr11 and the second reference voltage Vref2. Consequently, current of 60 mA is supplied to the LED string S11, as shown in Section (C). As a result, the upper part and lower part of the liquid crystal display panel 2 are illuminated at relatively low intensity.

At the time the subsequent period T3 is started, that is, when the upper part of the liquid crystal display panel 2 is turned off, the transistor Q341 is turned on. Consequently, as shown in Section (C), the supply of current to the LED string S11 is stopped. At the same time, that is, when the period T3 is started, the voltage that is output as the reference voltage Vref from the selector 336 to the differential amplifier circuit 332 is changed from the second reference voltage Vref2 to the first reference voltage Vref1, while the transistor Q342 remains off, as shown in Section (F). Therefore, the differential amplifier circuit 332 regulates the gate voltage of the field-effect transistor 33B in accordance with the detection voltage Vr12 and the first reference voltage Vref1. Consequently, current of 120 mA is supplied to the LED string S12, as shown in Section (D). As a result, only the lower part of the liquid crystal display panel 2 may be illuminated at relatively high intensity. At the end of the period T3, the transistor Q342 is turned on, and the backlight unit 3 is turned off. In the implementation shown in FIGS. 5 to 7, the period T1 corresponds to an example of a first period, the period T2 corresponds to an example of a second period, and the period T3 corresponds to an example of a third period.

As described above, in the implementation shown in FIGS. 5 to 7, the illuminated region on the liquid crystal display panel 2 changes from the upper part to the lower part from the period T1 through the period T3. However, with the period T2 during which the upper part and lower part are illuminated with a small light quantity, the transition of the illuminated region of the liquid crystal display panel 2 can be made less noticeable. In addition, in the implementation shown in FIGS. 5 to 7, because the differential amplifier circuits 331 and 332 control the gate voltages of the field-effect transistors 33A and 33B in two stages, the light quantity of the LED strings S11 and S12 can also be controlled in two stages. Therefore, the constant current source 321 does not have to be provided with current control function for controlling the light quantity and the current flowing in the constant current source 321 can be stabilized. Hence, the configuration of the constant current source 321 can be simplified as compared with the constant current source having the current control function.

Figure 8:
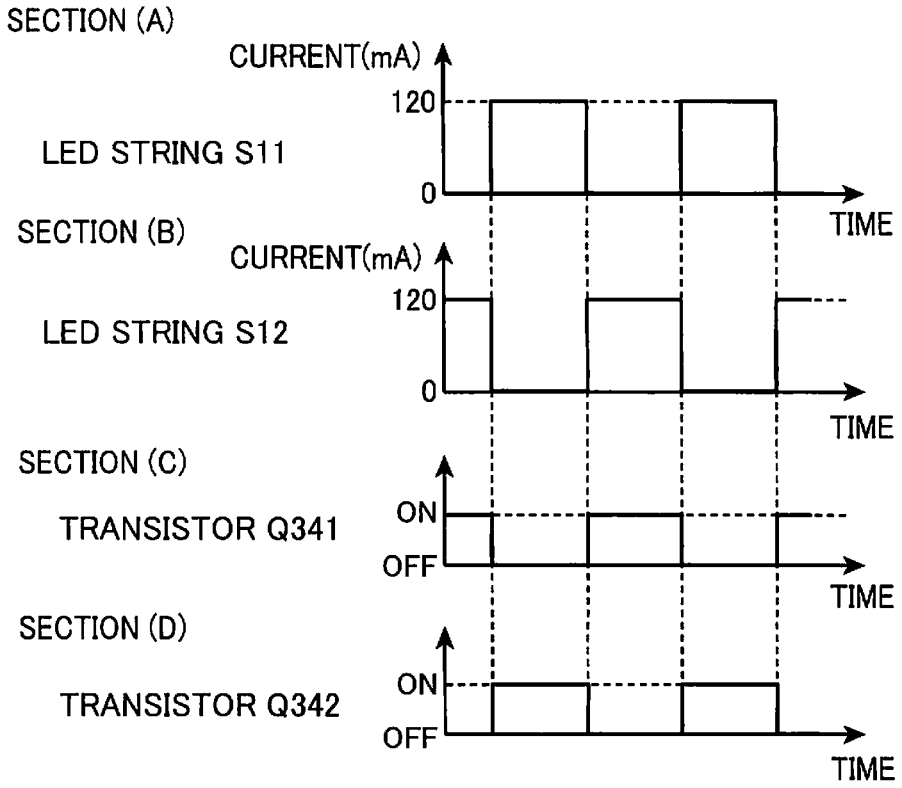
FIG. 8 is a timing chart showing another example of the operations by the LED strings in the configuration shown in FIG. 5.

FIG. 8 is a timing chart showing another example of the operations by the LED strings in the configuration shown in FIG. 5. Section (A) of FIG. 8 shows current flowing in the LED string S11. Section (B) of FIG. 8 shows current flowing in the LED string S12. Section (C) of FIG. 8 shows on-off states of the transistor Q341. Section (D) of FIG. 8 shows on-off states of the transistor Q342.

Note that the LED strings S11 and S12 are disposed in a manner shown in FIG. 6. In other words, the LED string S11 is disposed in the upper part of the liquid crystal display panel 2, whereas the LED string S12 is disposed in the lower part of the liquid crystal display panel 2. Moreover, in the present implementation, the constant current source 321 has a rated current of 120 mA, as described above.

In the operations shown in FIG. 8, the LED strings are turned on and off. As described above, the LED string S11 is turned on and off by the on-off operations of the transistor Q341. The LED string S12 is turned on and off by the on-off operations of the transistor Q342. In the operations shown in FIG. 8, the voltages that are output as the reference voltage Vref from the selector 336 to the differential amplifier circuits 331 and 332 include the first reference voltage Vref1.

In the operations shown in FIG. 8, the LED strings S11 and S12 that are connected in parallel with each other are turned on and off alternately. In other words, the constant current source 321 supplies currents to the LED strings S11 and S12 alternately and not simultaneously.

Therefore, as shown in Sections (A) and (B) of FIG. 8, the constant current source 321 can supply current of 120 mA to the LED string S11 and current of 120 mA to the LED string S12. As a result, a cost increase that is caused by increasing the rated current of the constant current source 321 can be prevented, increasing the intensity of the light illuminating the liquid crystal display panel 2.

In the circuit configuration shown in FIG. 5, while keeping the transistors Q341 and Q342 off, the voltages that are output as the reference voltage Vref from the selector 336 to the differential amplifier circuits 331 and 332 are set at the second reference voltage Vref2. Consequently, current of 60 mA can be supplied to the LED strings S11 and S12 to continuously turning the LED strings S11 and S12 on, as shown in FIG. 4. Further, as shown in FIG. 8, when only the operation for alternately turning the LED strings on and off is performed (i.e., when the operation for continuously turning the LED strings on shown in FIG. 4 is not performed), the reference voltage generating circuit 335 may be configured to output the first reference voltage Vref1 as the reference voltage Vref to the differential amplifier circuits 331 and 332. In this case, the selector 336 can be omitted.

Figure 9:
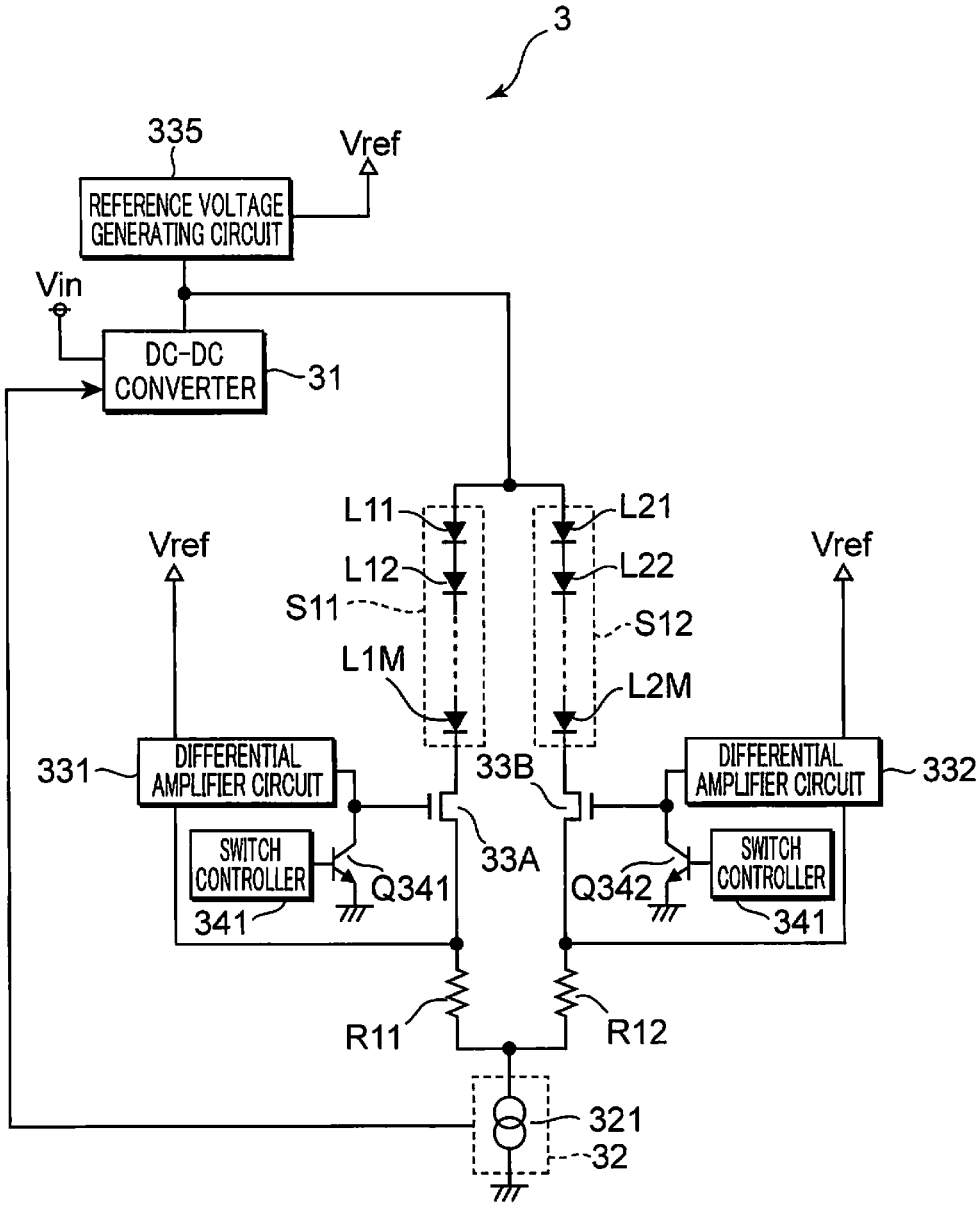
FIG. 9 is a circuit block diagram showing another example of the circuit configuration of the backlight unit.

FIG. 9 is a circuit block diagram showing another example of the circuit configuration of the backlight unit 3. The backlight unit 3 shown in FIG. 9 has one constant current source 321 and two LED strings S11 and S12. In the circuit configuration shown in FIG. 9, the two LED strings S11 and S12 are connected in parallel with one constant current source 321. However, the number of LED strings to be connected in parallel is not necessarily limited to two and can be three or more. Further, the circuit configuration shown in FIG. 9 has one constant current source 321. However, the number of constant current sources does not have to be one and can be two or more.

In the circuit configuration shown in FIG. 9, the current regulator 33 includes the differential amplifier circuit 331 and 332, the reference voltage generating circuit 335, the field-effect transistors 33A and 33B, and the current sensing resistors R11 and R12. The light emission controller 34 includes the switch controller 341 and the transistors Q341 and Q342. Note that the LED strings S11 and S12 are disposed in a manner shown in FIG. 6. In other words, the LED string S11 is disposed in the upper part of the liquid crystal display panel 2, whereas the LED string S12 is disposed in the lower part of the liquid crystal display panel 2.

Here, suppose that a left-eye image signal and a right-eye image signal are input to the signal processor 1 as the input image signals in FIG. 1. The signal processor 1 converts these 60-Hz input image signals into a 120-Hz left-eye image signal and a 120-Hz right-eye image signal, and outputs the resultant signals to the liquid crystal display panel 2. In synchronization with outputting the left-eye and right-eye image signals, the signal processor 1 outputs a control signal to the backlight unit 3. As a result, a stereoscopically perceivable image is displayed on the liquid crystal display panel 2.

Figure 10:
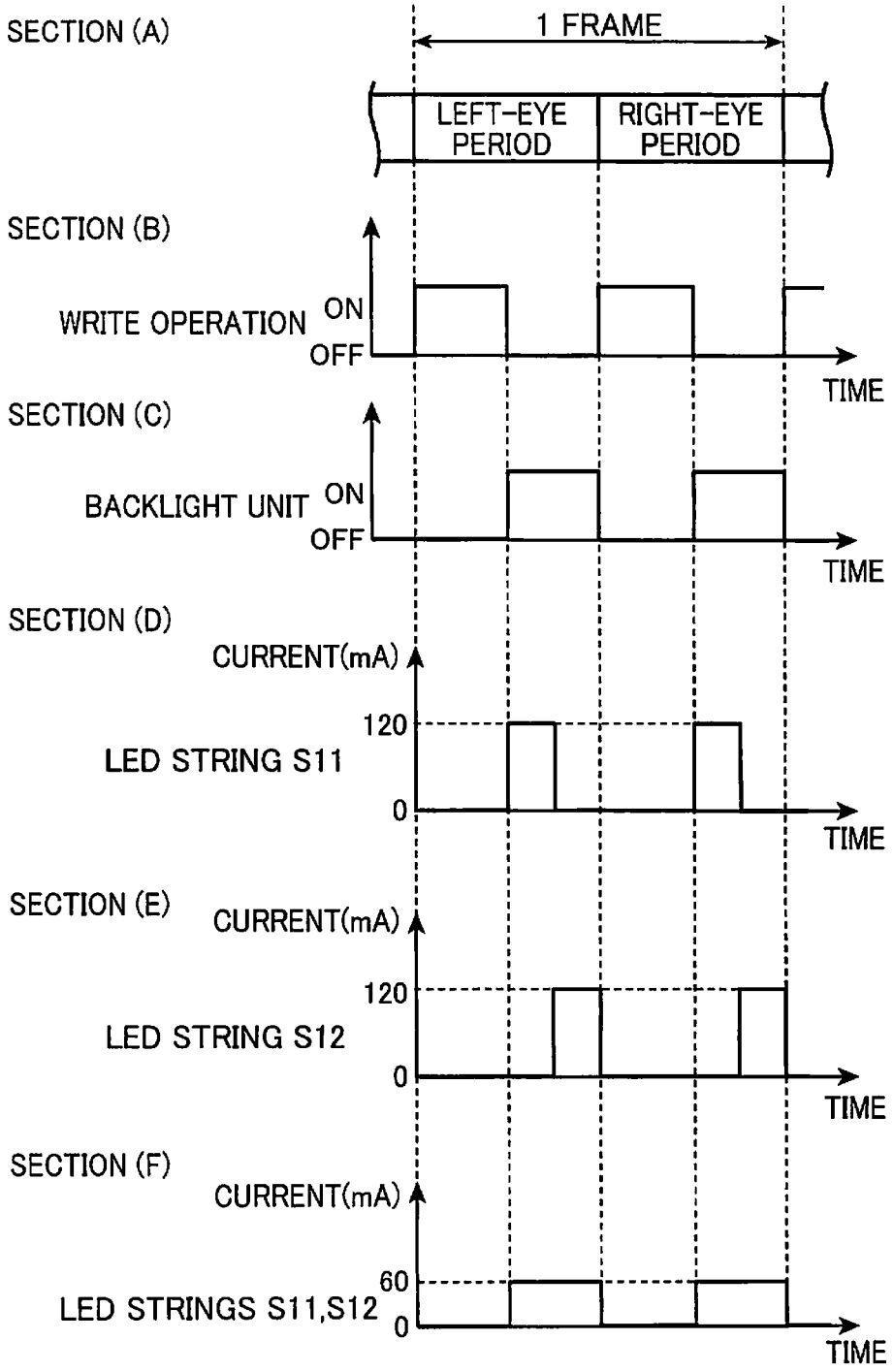
FIG. 10 is a timing chart showing an example of operations by the LED strings in the configuration shown in FIG. 9.

FIG. 10 is a timing chart showing an example of operations by the LED strings in the configuration shown in FIG. 9. Section (A) of FIG. 10 shows a left-eye period for displaying an image based on the left-eye image signal and a right-eye period for displaying an image based on the right-eye image signal. Section (B) of FIG. 10 shows write operations for writing on the pixels of the liquid crystal display panel 2. During the left-eye period, the write operation is executed based on the left-eye image signal that is input from the signal processor 1. During the right-eye period, the write operation is executed based on the right-eye image signal that is input from the signal processor 1. Section (C) of FIG. 10 shows an on-off operation of the backlight unit 3. The backlight unit 3 is turned on, during a period between when the write operations are completed and when the subsequent write operations are started. Sections (D) and (E) of FIG. 10 show current flowing when the LED strings S11 and S12 connected in parallel with the constant current source are alternately turned on. Specifically, Section (D) shows current flowing in the LED string S11, and Section (E) shows current flowing in the LED string S12. Section (F) of FIG. 10 shows currents flowing in the LED strings S11 and S12 when the LED strings S11 and S12 are connected in parallel with the constant current source and are simultaneously turned on.

Note that the LED strings S11 and S12 are disposed in a manner shown in FIG. 6. In other words, the LED string S11 is disposed in the upper part of the liquid crystal display panel 2, and the LED string S12 is disposed in the lower part of the liquid crystal display panel 2. When the LED strings S11 and S12 that are connected in parallel with the constant current source are turned on simultaneously, and when the constant current source has a rated current of 120 mA, for example, current of 60 mA flows in the LED strings S11 and S12, as shown in Section (F) of FIG. 10. At this time, a duty of backlights for left-eye or right-eye is 25% per frame cycle. In addition, a peak current Ip-p is 60 mA. Therefore, an effective current is $60\ \text{mA}\times(0.25)^{1/2}=30\ \text{mArms}$.

On the other hand, when the LED strings S11 and S12 are connected in parallel as shown in FIG. 9 and are turned on individually, current of 120 mA is supplied to each of the LED strings S11 and S12 during a period in which the duty is 25%/2. Thus, the effective current is $120\ \text{mA}\times(0.25/2)^{1/2}=42.4\ \text{mArms}$. As a result, the light quantity of the LED strings S11 and S12 can be increased, resulting in an increase in the brightness of the backlight unit 3.

The circuit configuration of the backlight unit 3 is not limited to the examples shown in FIGS. 2, 5, and 9. Additional examples of the circuit configuration of the backlight unit 3 are described with reference to FIGS. 11 to 16.

Figure 11:
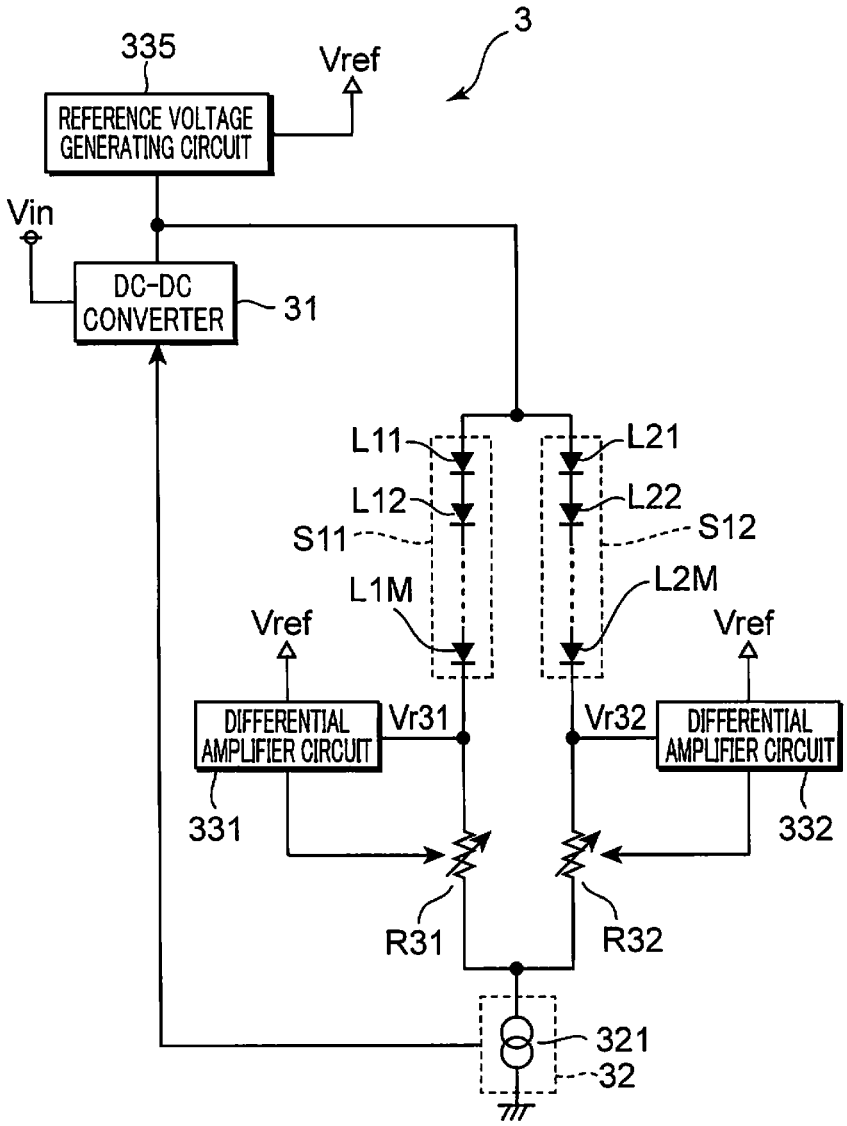
FIG. 11 is a circuit block diagram showing yet another example of the circuit configuration of the backlight unit.

FIG. 11 is a circuit block diagram showing yet another example of the circuit configuration of the backlight unit 3 according to the present implementation. The backlight unit 3 shown in FIG. 11 has one constant current source 321 and two LED strings S11 and S12. In the circuit configuration shown in FIG. 11, two LED strings S11 and S12 are connected in parallel with one constant current source 321. However, the number of LED strings to be connected in parallel is not limited to two and can be three or more LED strings. In addition, the circuit configuration shown in FIG. 11 has one constant current source 321. However, the number of constant current sources does not have to be one and can be two or more. The same is true for the examples shown in FIGS. 12 to 16, which are described hereinafter.

In the circuit configuration shown in FIG. 11, the current regulator 33 includes the differential amplifier circuits 331 and 332, the reference voltage generating circuit 335, and variable resistors R31 and R32.

In the example of the circuit configuration shown in FIG. 11, the variable resistor R31 is connected in series between the LED string S11 and the constant current source 321. The variable resistor R32 is connected in series between the LED string S12 and the constant current source 322. The differential amplifier circuit 331 controls a resistance value of the variable resistor R31 in accordance with a detection voltage Vr31 of the variable resistor R31 and the reference voltage Vref. The differential amplifier circuit 332 controls a resistance value of the variable resistor R32 in accordance with a detection voltage Vr32 of the variable resistor R32 and the reference voltage Vref.

In the circuit configuration shown in FIG. 11, currents flowing in the LED strings S11 and S12 can be equalized. Note that the variable resistors R31 and R32 can be configured by, for example, field-effect transistors. In other words, increasing the gate voltages of the field-effect transistors can reduce on-resistances of the field-effect transistors, and on the other hand, reducing the gate voltages can increase the on-resistances.

Figure 12:
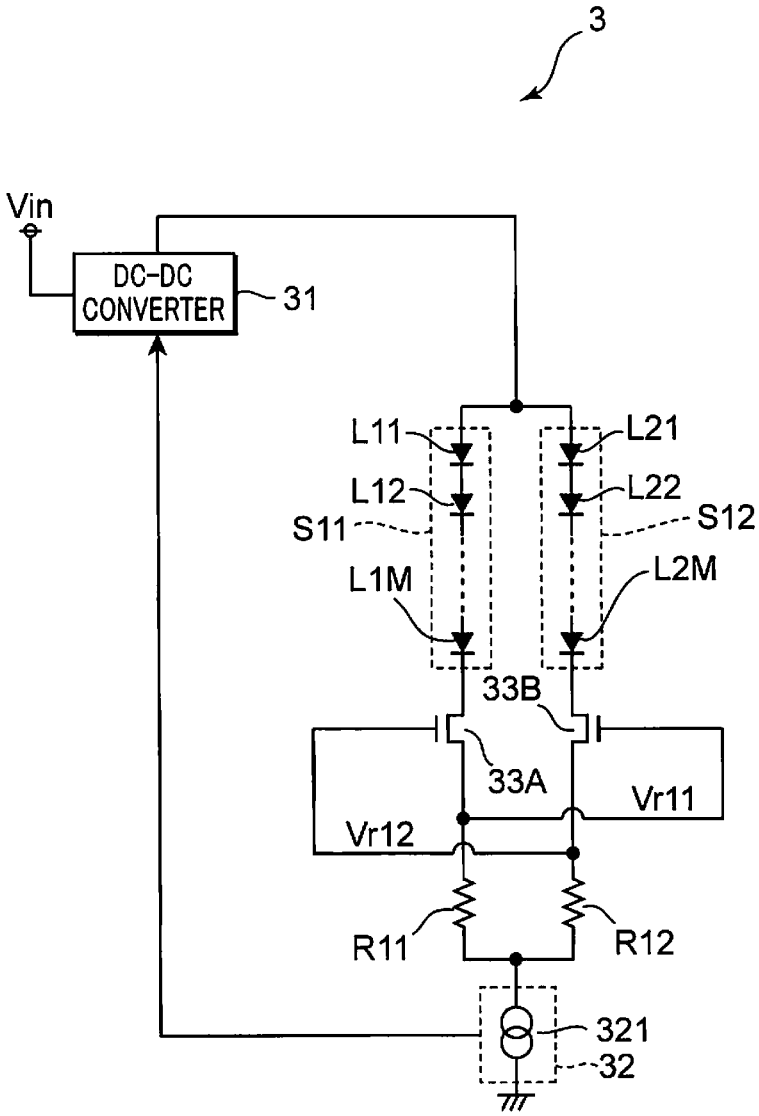
FIG. 12 is a circuit block diagram showing yet another example of the circuit configuration of the backlight unit.

FIG. 12 is a circuit block diagram showing yet another example of the circuit configuration of the backlight unit 3. In the circuit configuration shown in FIG. 12, the current regulator 33 includes the field-effect transistors 33A and 33B, and current sensing resistors R11 and R12. The gate of the field-effect transistor 33A is connected to the connection point between the resistor R12 and the field-effect transistor 33B. The gate of the field-effect transistor 33B is connected to the connection point between the resistor R11 and the field-effect transistor 33A.

In the circuit configuration shown in FIG. 12, the current flowing in the other LED string is used for reference. When the current flowing in the LED string S12 increases, the detection voltage Vr12 of the current sensing resistor R12 rises, increasing the gate voltage of the field-effect transistor 33A. Therefore, the current flowing in the field-effect transistor 33A, which is the current flowing in the LED string S11, can be increased. On the other hand, when the current flowing in the LED string S12 decreases, the detection voltage Vr12 of the current sensing resistor R12 drops, decreasing the gate voltage of the field-effect transistor 33A. Therefore, the current flowing in the field-effect transistor 33A, which is the current flowing in the LED string S11, can be reduced.

Similarly, when the current flowing in the LED string S11 increases, the detection voltage Vr11 of the current sensing resistor R11 rises, increasing the gate voltage of the field-effect transistor 33B. Therefore, the current flowing in the field-effect transistor 33B, which is the current flowing in the LED string S12, can be increased. On the other hand, when the current flowing in the LED string S11 decreases, the detection voltage Vr11 of the current sensing resistor R11 drops, decreasing the gate voltage of the field-effect transistor 33B. Therefore, the current flowing in the field-effect transistor 33B, which is the current flowing in the LED string S12, can be reduced. As a result, currents flowing in the LED strings S11 and S12 can be equalized also in the circuit configuration shown in FIG. 12.

Figure 13:
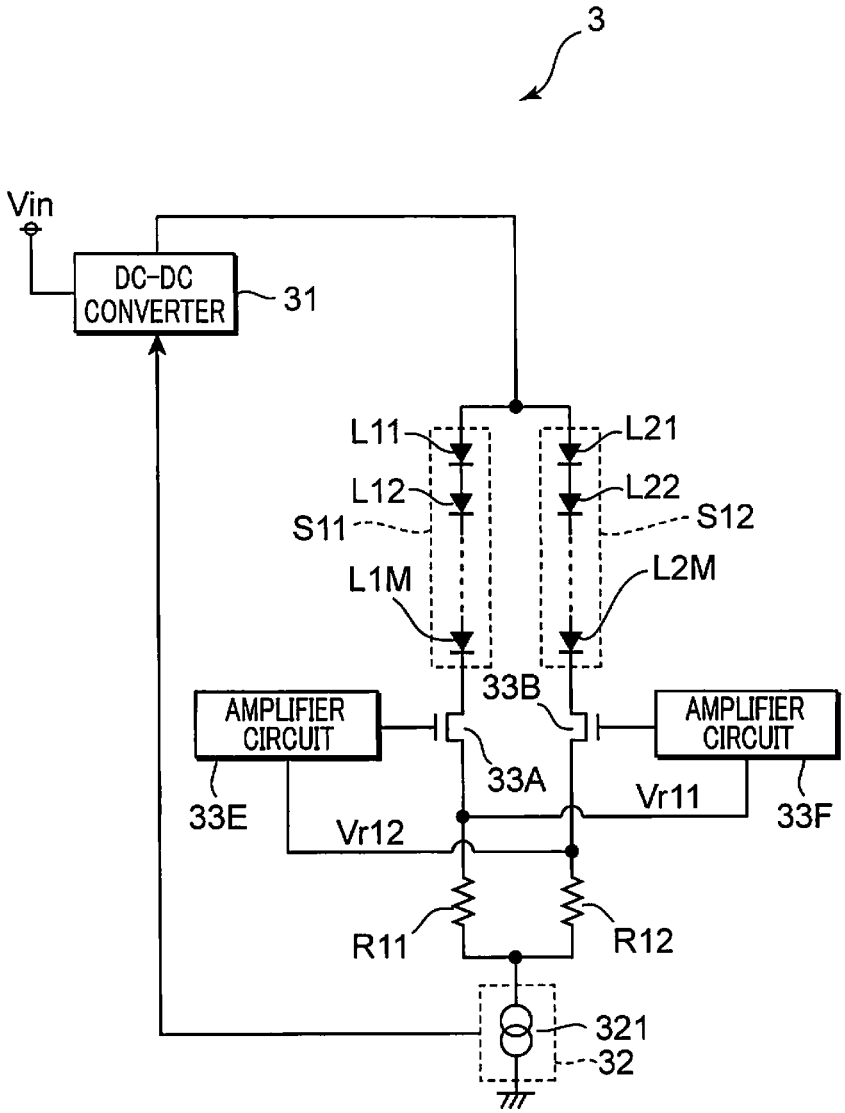
FIG. 13 is a circuit block diagram showing yet another example of the circuit configuration of the backlight unit.

FIG. 13 is a circuit block diagram showing yet another example of the circuit configuration of the backlight unit 3. In the circuit configuration shown in FIG. 13, amplifier circuits 33E and 33F are added to the circuit configuration shown in FIG. 12. In other words, the gate of the field-effect transistor 33A is connected to the connection point between the resistor R12 and the field-effect transistor 33B via the amplifier circuit 33E. The gate of the field-effect transistor 33B is connected to the connection point between the resistor R11 and the field-effect transistor 33A via the amplifier circuit 33F. In the circuit configuration shown in FIG. 13, the current regulator 33 includes the amplifier circuits 33E and 33F, the field-effect transistors 33A and 33B, and the current sensing resistors R11 and R12.

The amplifier circuit 33E applies a voltage obtained by amplifying the detection voltage Vr12 of the resistor R12, to the gate of the field-effect transistor 33A. The amplifier circuit 33F applies a voltage obtained by amplifying the detection voltage Vr11 of the resistor R11, to the gate of the field-effect transistor 33B. Because the circuit configuration shown in FIG. 13 operates in the same manner as the circuit configuration shown in FIG. 12, currents flowing in the LED strings S11 and S12 can be equalized.

Figure 14:
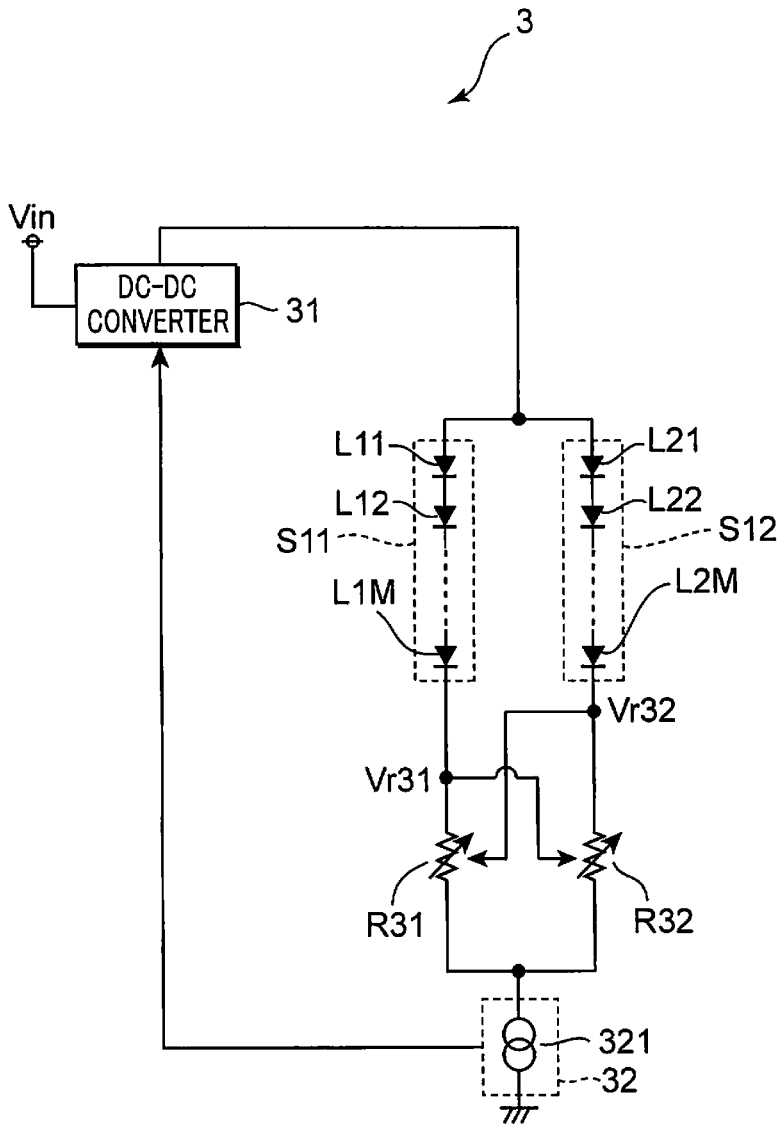
FIG. 14 is a circuit block diagram showing yet another example of the circuit configuration of the backlight unit.

FIG. 14 is a circuit block diagram showing yet another example of the circuit configuration of the backlight unit 3. In the circuit configuration shown in FIG. 14, neither the differential amplifier circuits nor the reference voltage generating circuit is provided, and variable resistors are connected in place of the field-effect transistors and current sensing resistors. In other words, a variable resistor R31 is connected in series between the LED string S11 and the constant current source 321, while a variable resistor R32 is connected in series between the LED string S12 and the constant current source 322. In the circuit configuration shown in FIG. 14, the current regulator 33 includes the variable resistors R31 and R32.

In the circuit configuration shown in FIG. 14, the current flowing in the other LED string is used for reference. The resistance values of the variable resistors R31 and R32 are controlled based on the detection voltages Vr32 and Vr31 of the variable resistors R32 and R31, respectively. In other words, when the detection voltage Vr32 rises, the resistance value of the variable resistor R31 is reduced. When the detection voltage Vr32 drops, the resistance value of the variable resistor R31 increases. When the detection voltage Vr31 rises, the resistance value of the variable resistor R32 drops. When the detection voltage Vr31 drops, the resistance value of the variable resistor R32 increases. Therefore, in the circuit configuration shown in FIG. 14 because the resistance values of the variable resistors R31 and R32 are controlled in the same manner as the resistance values of the variable resistors R31 and R32 shown in FIG. 11, currents flowing in the LED strings S11 and S12 can be equalized.

Figure 15:
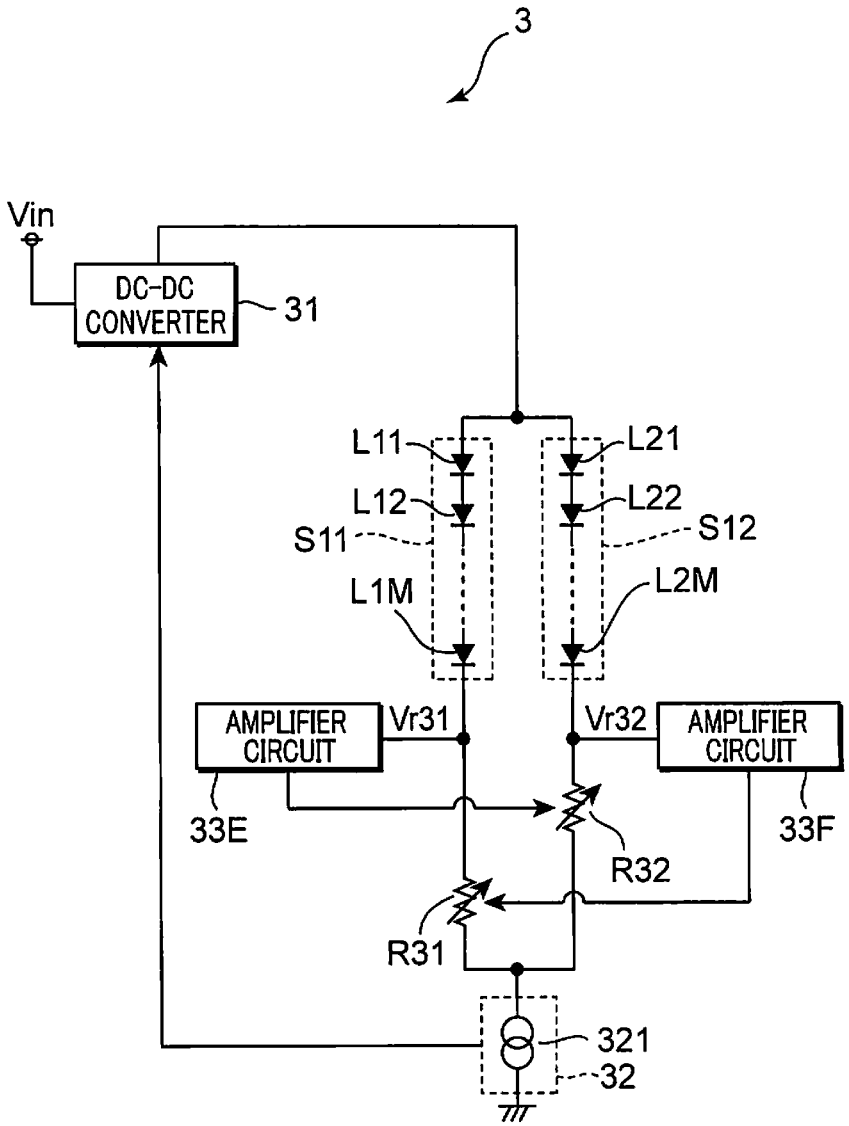
FIG. 15 is a circuit block diagram showing yet another example of the circuit configuration of the backlight unit.

FIG. 15 is a circuit block diagram showing yet another example of the circuit configuration of the backlight unit 3. In the circuit configuration shown in FIG. 15, amplifier circuits 33E and 33F are added to the circuit configuration shown in FIG. 14. In other words, the resistance value of the variable resistor R31 is controlled by the amplified voltage of the detection voltage Vr32 of the variable resistor R32 amplified by the amplifier circuit 33F. The resistance value of the variable resistor R32 is controlled by the amplified voltage of the detection voltage Vr31 of the variable resistor R31 amplified by the amplifier circuit 33E. In the circuit configuration shown in FIG. 15, the current regulator 33 includes the amplifier circuits 33E and 33F and the variable resistors R31 and R32. The circuit configuration shown in FIG. 15 is exactly the same as that shown in FIG. 14, except that the circuit configuration shown in FIG. 15 has the amplifier circuits 33E and 33F. Thus, as with the circuit configuration shown in FIG. 14, currents flowing in the LED strings S11 and S12 can be equalized also in the circuit configuration shown in FIG. 15.

Figure 16:
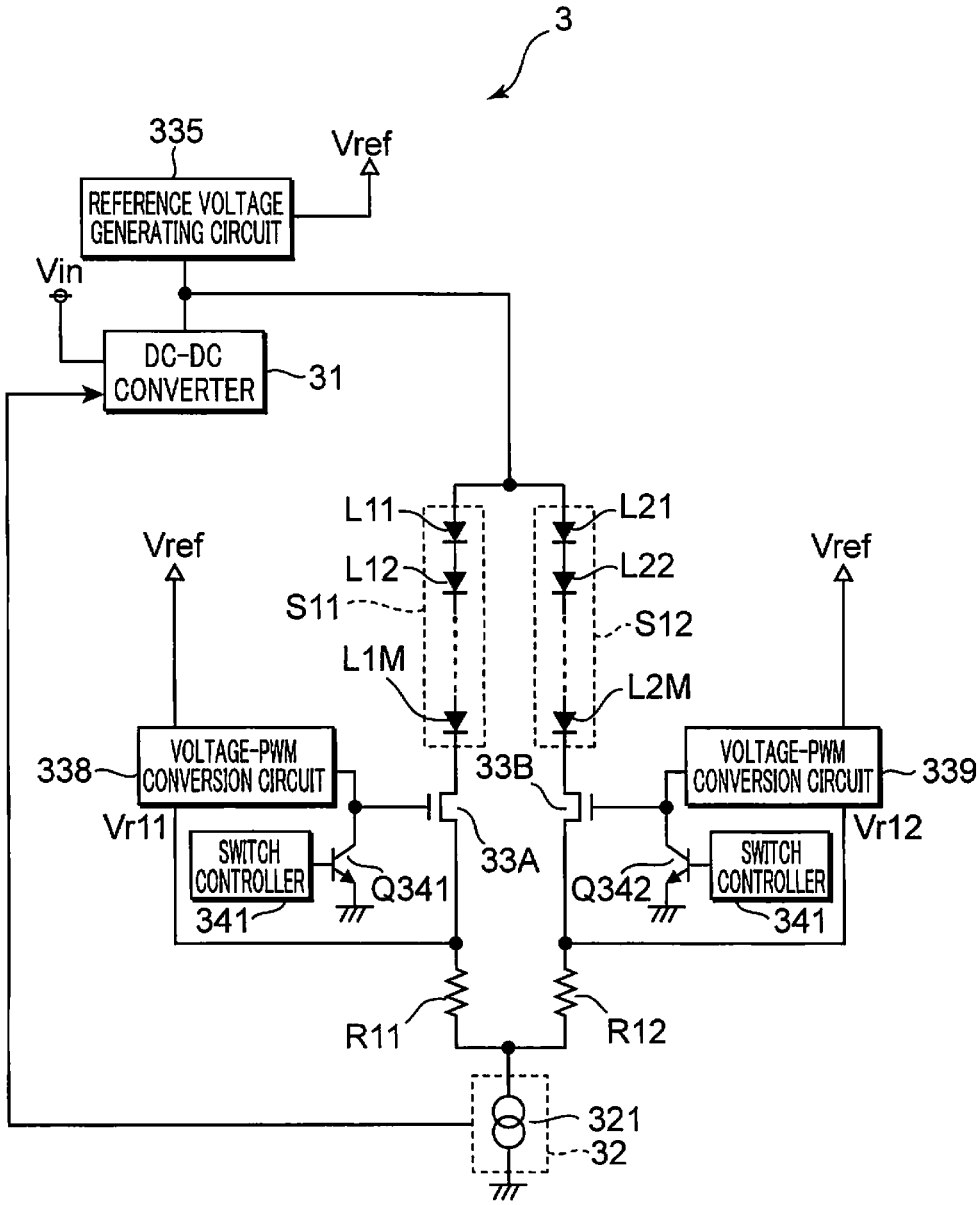
FIG. 16 is a circuit block diagram showing yet another example of the circuit configuration of the backlight unit.

FIG. 16 is a circuit block diagram showing yet another example of the circuit configuration of the backlight unit 3. The circuit configuration shown in FIG. 16 has voltage-PWM conversion circuits 338 and 339 in place of the differential amplifier circuits. The rest of the configuration of the circuit configuration shown in FIG. 16 is same as that of the circuit configuration shown in FIG. 9.

In the circuit configuration shown in FIG. 16, the current regulator 33 includes the voltage-PWM conversion circuits 338 and 339, the reference voltage generating circuit 335, the field-effect transistors 33A and 33B, and the current sensing resistors R11 and R12. The light emission controller 34 includes the switch controller 341 and the transistors Q341 and Q342.

The voltage-PWM conversion circuit 338 outputs a PWM signal to the gate of the field-effect transistor 33A so that the detection voltage Vr11 of the current sensing resistor R11 becomes equal to the reference voltage Vref. In other words, when the Vr11 is greater than the Vref, the voltage-PWM conversion circuit 338 outputs a PWM signal that drops the gate voltage of the field-effect transistor 33A. When, on the other hand, the Vr11 is lower than the Vref, the voltage-PWM conversion circuit 338 outputs a PWM signal that increases the gate voltage of the field-effect transistor 33A. The voltage-PWM conversion circuit 339 operates in the same manner as the voltage-PWM conversion circuit 338. Therefore, the voltage-PWM conversion circuits 338 and 339 control the field-effect transistors 33A and 33B so that the detection voltages Vr11 and Vr12 of the current sensing resistors R11 and R12 become equal to each other as follows: Vref=Vr11=Vr12. As a result, currents flowing in the LED strings S11 and S12 become equal to each other. Therefore, the circuit configuration shown in FIG. 16 can also prevent or reduce the variations in the light quantity of each light-emitting diode L11 and the like.

In the implementation described above, the number of light-emitting diodes included in the LED strings S11 and the like is set as, for example, M=10; however, M may be one or more. Even when M=1, variations in the light quantity of one light-emitting diode configuring the LED string S11 and the light quantity of one light-emitting diode configuring the LED string S12 can be prevented or reduced.

The implementation described above mainly includes inventions having the following configurations.

The display apparatus of the instant application has several advantages. In one aspect, even when there are fluctuations in the forward voltages of the light-emitting diodes and the forward voltages of the light-emitting diode strings are different from each other, since each current flowing in each of the light-emitting diode strings may be regulated by the current regulator, the variations in the light quantity of the light-emitting diodes configuring the light-emitting diode strings may be prevented or reduced, without increasing the labor and costs. Moreover, because the drive unit is connected in series with the group of light-emitting diode strings in which the N light-emitting diode strings are connected in parallel with each other, the number of drive units may be reduced to 1/N, as compared to the configuration in which the drive units are respectively connected in series with the light-emitting diode strings. Thus, a simple configuration can be achieved.

In another aspect, by controlling the current regulating element based on the reference voltage and the detection voltage, it may be possible to regulate each current flowing in the resistor element, that is, each current flowing in each of the light-emitting diode strings connected in series with the resistor element. As a result, it may be possible to prevent or reduce the variations in the light quantity of the light-emitting diodes included in the light-emitting diode strings. In addition, the current regulator element is connected in series with the drive unit. Hence, it may be possible to increase the withstand voltage of the drive unit by the level of the withstand voltage of the current regulating element.

In another aspect, by controlling the transistor by the voltages generated by the amplifier circuit, it may be possible to favorably regulate each current flowing in each of the light-emitting diode strings. As a result, it may be possible to prevent or reduce the variations in the light quantity of the light-emitting diodes included in each of the light-emitting diode strings. In addition, the transistor is connected in series with the drive unit. Hence, it may be possible to increase the withstand voltage of the drive unit by the level of the withstand voltage of the transistor.

In another aspect, because the amplifier circuit of the backlight device may be a differential amplifier circuit, each amplifier circuit can be configured more simply than an ordinary amplifier circuit.

In another aspect, by controlling a transistor by means of the PWM signal output by a PWM circuit, the display apparatus of the instant application may be able to favorably regulate each current flowing in each of the light-emitting diode strings. As a result, it may be possible to prevent the variations in the light quantity of the light-emitting diodes configuring each of the light-emitting diode strings. In addition, the transistor is connected in series with the drive unit. Hence, it may be possible to increase the withstand voltage of the drive unit by the level of the withstand voltage of the transistor. The transistor of the display apparatus may include a field-effect transistor. Therefore, almost no current flows to the gate thereof, and hence, it may be possible to reduce current loss.

In another aspect, the display apparatus of the instant application may prevent or reduce the variations in the light quantity of each of the light-emitting diodes which configure each of the light-emitting diode strings to which current is supplied.

Generally, the drive unit may supply current within the range of a rated current. Therefore, when the drive unit with the same rated current is used, more current can be supplied when simultaneously supplying current to one or each of the K light-emitting diode strings out of the N light-emitting diode strings, compared to when simultaneously supplying current to each of the N light-emitting diode strings that are connected in parallel. As a result, by supplying more current to the light-emitting diode strings using the drive unit with the same rated current, the light quantity of the light-emitting diodes can be increased, without having the costs of the drive unit increased. Thus, the display panel can be illuminated at higher intensity.

The light emission controller of the display apparatus may perform a control so that the current is supplied from the drive unit to each of the N light-emitting diode strings sequentially and one by one, and the current regulator may regulate each current that is supplied to each of the N light-emitting diode strings sequentially and one by one by the light emission controller. According to this configuration, it may be possible to cause the N light-emitting diode strings to emit light with the same light quantity one by one, without causing variations in the light quantity of each of the light-emitting diodes which configure each of the light-emitting diode strings to which current is supplied.

In another aspect, the light emission controller of the display apparatus may perform a control so that the current is supplied from the drive unit to the one or each of the K light-emitting diode strings every predetermined period, and the current regulator may regulate each current supplied to the one or each of the K light-emitting diode strings every predetermined period by the light emission controller. According to this configuration, it may be possible to cause the one or each of the K light-emitting diode strings to emit light with the same light quantity one by one, without causing variations in the light quantity of each of the light-emitting diodes which configure each of the light-emitting diode strings to which current is supplied.

In another aspect, the instant application describes a display apparatus in which N light-emitting diode strings illuminate different regions of the display panel. The N light-emitting diode strings include a first light-emitting diode string and a second light-emitting diode string that illuminate the regions adjacent to each other. The light emission controller may perform control so that current may be supplied from the drive unit to only the first light-emitting diode string during a first period, that current may be supplied from the drive unit to each of the first and second light-emitting diode strings during a second period subsequent to the first period, and that current is supplied from the drive unit to only the second light-emitting diode string during a third period subsequent to the second period. Therefore, by regulating each current flowing in each of the light-emitting diode strings by the current regulator, it may be possible to alternately and smoothly illuminate, at uniform intensity, the regions of the display panel that are adjacent to each other.

In yet another aspect, each current flowing in each of the N light-emitting diode strings that are connected in parallel with each other may be regulated. Therefore, even when there are fluctuations in the forward voltages of the light-emitting diodes, and the forward voltages of the entire light-emitting diode strings may be different from each other, it may be possible to prevent variations in the light quantity of the respective light-emitting diodes configuring the light-emitting diode strings.

The display apparatus of the instant application may be useful as a display apparatus capable of reducing fluctuations in brightness that are caused due to the individual difference in the respective light-emitting diode elements.

While the foregoing has described what are considered to be the best mode and/or other examples, it is understood that various modifications may be made therein and that the subject matter disclosed herein may be implemented in various forms and examples, and that they may be applied in numerous applications, only some of which have been described herein. It is intended by the following claims to claim any and all modifications and variations that fall within the true scope of the present teachings.

What is claimed is:

1. A display apparatus comprising:

a display panel configured to display an image; and a backlight unit configured to illuminate the display panel from a back of the display panel, wherein the backlight unit includes:

N light-emitting diode strings connected in parallel with each other, each of the N light-emitting diode strings includes M light-emitting diodes connected in series, N being an integer of 2 or more and M being an integer of 1 or more;

a power source unit connected in series with the N light-emitting diode strings and configured to generate a voltage;

a drive unit connected in series with the N light-emitting diode strings and the power source unit and configured to supply currents to the N light-emitting diode strings; and a current regulator configured to regulate current flowing in each of the N light-emitting diode strings, each of the N light-emitting diode strings illuminates different regions of the display panel, and the N light-emitting diode strings include a first light-emitting diode string and a second light-emitting diode string, illuminating regions adjacent to each other, the display apparatus further comprises a light emission controller configured to perform a control so that current is supplied from the drive unit to only the first light-emitting diode string during a first period, that current is supplied from the drive unit to each of the first and second light-emitting diode strings during a second period subsequent to the first period, and that current is supplied from the drive unit to only the second light-emitting diode string during a third period subsequent to the second period.

2. The display apparatus according to claim 1, wherein the current regulator includes:

a reference voltage generating circuit configured to generate a reference voltage;

a resistor element and current regulating element connected in series with each of the N light-emitting diode string; and a control circuit configured to control the current regulating element based on the reference voltage generated by the reference voltage generating circuit and a detection voltage detected by the resistor element.

3. The display apparatus according to claim 2, wherein:

the current regulating element includes a transistor connected in series with each of the N light-emitting diode strings, and the control circuit includes an amplifier circuit configured to generate a voltage, which controls the transistor, based on the reference voltage and the detection voltage.

4. The display apparatus according to claim 3, wherein the amplifier circuit includes a differential amplifier circuit.

5. The display apparatus according to claim 2, wherein:

the current regulating element includes a transistor connected in series with each of the N light-emitting diode strings, and the control circuit includes a Pulse Width Modulation (PWM) circuit configured to output a PWM signal, which controls the transistor based on the reference voltage and the detection voltage.

6. The display apparatus according to claim 3, wherein the transistor includes a field-effect transistor.

7. The display apparatus according to claim 1, wherein the light emission controller is configured to control, out of the N light-emitting diode strings, K light-emitting diode strings to which the currents are supplied simultaneously from the drive unit, K is an integer of 2 or more but less than N, and the current regulator is configured to regulate each current flowing in each of the K light-emitting diode strings.

8. The display apparatus according to claim 7, wherein:

the light emission controller is configured to perform a control so that the current is supplied from the drive unit to the one or each of the K light-emitting diode strings at a predetermined period, and the current regulator is configured to regulate each current supplied to the one or each of the K light-emitting diode strings at the predetermined period by the light emission controller.

9. The display apparatus according to claim 1, wherein the light emission controller is configured to perform a control so that the current is supplied from the drive unit to each of the N light-emitting diode strings sequentially and one by one, and the current regulator is configured to regulate each current that is supplied to each of the N light-emitting diode strings sequentially and one by one by the light emission controller.

* * * * *